US006503853B1

(12) United States Patent
Kassner et al.

(10) Patent No.: US 6,503,853 B1
(45) Date of Patent: Jan. 7, 2003

(54) TEXTILE NETTING FOR REINFORCING LAYERS CONNECTED BY BITUMEN

(75) Inventors: Jürgen Kassner, Gescher (DE); Heiko Pintz, Nordhorn (DE); Ulrich Von Fransecky, Bocholt (DE)

(73) Assignee: Huesker Synthetic GmbH & Co., Gescher (DE)

( * ) Notice: Subject to any disclaimer, the term of this patent is extended or adjusted under 35 U.S.C. 154(b) by 0 days.

(21) Appl. No.: 09/331,282

(22) PCT Filed: Dec. 5, 1997

(86) PCT No.: PCT/EP97/06809

§ 371 (c)(1),
(2), (4) Date: Oct. 4, 1999

(87) PCT Pub. No.: WO98/27282

PCT Pub. Date: Jun. 25, 1998

(30) Foreign Application Priority Data

Dec. 17, 1996 (DE) ..... 196 52 584

(51) Int. Cl.[7] ..... B32B 5/26; B32B 3/10

(52) U.S. Cl. ..... 442/57; 442/1; 442/35; 442/43; 442/48; 442/50; 442/54; 442/58; 428/102; 428/131

(58) Field of Search ..... 442/1, 50, 54, 442/57, 58, 43, 48, 35; 428/102, 131

(56) References Cited

U.S. PATENT DOCUMENTS

| | | | | |
|---|---|---|---|---|
| 4,211,807 A | * | 7/1980 | Yazawa et al. | 428/109 |
| 4,472,086 A | | 9/1984 | Leach | 405/258 |
| 5,468,546 A | | 11/1995 | Loftus et al. | 428/280 |

FOREIGN PATENT DOCUMENTS

| | | |
|---|---|---|
| DE | 2000937 | 7/1971 |
| DE | 195 43 991 A1 | 11/1995 |
| EP | 0413295 A1 | 8/1990 |

OTHER PUBLICATIONS

English abstract for DE 4343888.
English abstract for DE 3835929.
English abstract For DE 4737393.
English abstract for DE 3734584.
English abstract for DE 4337984.
English abstract for DE 4123055.
English abstract for EP 67237.
English abstract for DE 2614160.
English abstract for DE 4300635.

* cited by examiner

*Primary Examiner*—Elizabeth M. Cole
*Assistant Examiner*—Norca L. Torres
(74) *Attorney, Agent, or Firm*—Choate, Hall & Stewart

(57) ABSTRACT

The invention relates to a wide-meshed, textile lattice to provide reinforcement for bitumen-bonded layers, in particular of road surfacing, which is coated with a bonding compound having an affinity for bitumen and essentially consisting of two sets of parallel, load-bearing threads (1, 2), whereby one set of threads (1) extends in the longitudinal direction of the lattice and the other set of threads extends in the direction perpendicular to the longitudinal direction of the lattice and the threads (1, 2) are of glass fibres or chemical fibres such as polymer fibres or polycondensate fibres.

In order to develop a reinforcing lattice for bitumen-bonded layers which provides a better bond with a pre-prepared formation than the known lattices, the over-crossed threads (1, 2) are secured to a thin fleece (3) by Raschel-locking, whereby the binding Raschel-locking threads (5) surround the longitudinally extending threads (1) of the lattice and secure the threads (2) extending transversely.

18 Claims, 2 Drawing Sheets

TEXTILE NETTING FOR REINFORCING LAYERS CONNECTED BY BITUMEN

FIELD OF THE INVENTION

The invention relates to a wide-meshed, textile lattice to provide reinforcement for bitumen-bonded layers, in particular for road surface.

BACKGROUND OF THE INVENTION

The lattice essentially consists two sets of parallel, load-bearing threads, whereby one set of threads extends in the longitudinal direction of the lattice and the other set of threads extends transversely to the longitudinal direction of the lattice and the threads are made from glass fibers or chemical fibers such as polymer fibers or polycondensate fibers and are Raschel-locked onto a fleece, whereby the connecting Raschel-locking threads surround the longitudinally extending threads of the lattice and secure the transversely extending threads.

The lattice may be woven or Raschel-locked but alternatively the load-bearing parallel threads running transversely to the longitudinal direction may be laid on the load-bearing parallel threads and bonded to the longitudinal threads at the intersecting points by bonding and welding.

A lattice bonded to a fleece of this type is known from publication EP 0 413 295 A. The geo-textile used for reinforcing layers of asphalt known from this publication is a bonding material consisting of two components, one of these components being a fleece and a second of these components a woven fabric, knitted fabric, thread pattern, lattice or any other flat layout having a defined yarn position. The bonding material is provided as a Raschel-locked material in which the two components are integrated one in the other by means of an end-latching Raschel technique. The fleece is designed to have a good capacity for absorbing bitumen so that when the geo-textile is laid down, this fleece becomes impregnated with bitumen and acts as a barrier to water. The fleece is also intended as a means of preventing the occur rence of tearing and the propagation of tearing in the layers of asphalt. The weight of the fleece by surface area should be 50 to 300 g/m$^2$, preferably 100 to 180 g/m$^2$. This geo-textile forms a separating layer in the installed state.

DE 20 00 937 discloses a wide-meshed textile lattice for reinforcing road surfacing, which is pre-fabricated so that it is coated with a specific bonding substance having an affinity to bitumen, e.g. a bitumen-latex emulsion, in order to produce a good adhesion between the lattice and the bitumen bonded layers.

In order to obtain a firm bond between the layers of the road surfacing on the two sides of the reinforcing lattice, there is an advantage to be had if the lattice is made with a wide mesh so that the distance between the parallel threads in the longitudinal direction and those in the transverse direction is 20 to 100 mm. The mesh width should be determined on the basis of the largest grain diameter of the surfacing mixture to be used. Advantageously, the mesh width is 2 to 2.5 times greater than the largest grain diameter. The load-bearing threads in the longitudinal and transverse directions should have a breaking strength of from 10 to 100 kN/m. If necessary or desirable, even stronger threads can be used for the reinforcing lattice.

As a result of the coating of bonding substance, the lattice is of a semi-rigid consistency. The lattice, which is 5 m wide and 30 or 50 m long, for example, is rolled out onto a surface which has been evenly sprayed with a bonding compound or bitumen emulsion. The reinforcing lattice should be laid out flat and free of folds before any further surfacing mixture is applied to the reinforcing lattice. In the case of these known lattices, a difficulty arises in that once rolled out, the reinforcing lattice slides causing creases, particularly when vehicles are driven over the laid-out lattice.

It is therefore desirable to develop a reinforcing lattice for bitumen-bonded layers which does not act as a separating layer between these layers and which provides better bonding than the known lattices on a pre-prepared road level.

SUMMARY OF THE INVENTION

In general, according to one aspect of the invention, the fleece has a weight of 10 to 50 g/m$^2$ and that the load bearing threads are treated and coated together with the fleece, with a bonding substance having an affinity to bitumen, the fleece having openings in the coating of bonding substance and being perforated in order to be permeable to air.

Due to the fact that the mesh of the lattice is filled with a thin fleece, a significantly stronger bond is produced when the lattice is laid on the formation. On the other hand, the fleece is so thin and consequently so flexible that the fleece does not act as a separating layer between the asphalt layers underneath and above the lattice. In spite of the existence of the fleece, nevertheless a firm keying action between the coarse grains of the surfacing mixture laid on top of the lattice and the coarse grains of the surfacing mixture underneath the lattice is achieved.

Due to the fact that the load-bearing threads of the lattice in the direction of the warp are lashed by the Raschel locking threads, the load-bearing threads running at right-angles thereto are fixed at their respective distances from one another. In another variant of the embodiment of the invention, there is no need for the lattice to be impregnated or coated with a bonding compound having an affinity for bitumen if the load-bearing threads are made from a polymer or a polycondensate, which in itself provides a firm bond with bitumen.

Furthermore, the underside of the composite of the textile lattice and the thin fleece may be provided with a bituminous mastic. This bituminous mastic melts when the hot asphalt mixture needed to form the bituminous surfacing is deposited on the laid lattice matting. It is advantageous to apply the bituminous mastic only in spots or stripes parallel with the winding axis in order to preserve the flexibility of the reinforcing lattice. The quantity of the bitumen-latex emulsion to be sprayed on the road level.

Due to the fact that the load-bearing threads of the lattice in the direction of the warp are lashed by the Raschel locking threads, the load-bearing threads running at right-angles thereto are fixed at their respective distances from one another.

According to another embodiment of the invention, there is no need for the lattice to be impregnated or coated with a bonding compound having an affinity for bitumen if the load-bearing threads are made from a polymer or a polycondensate, which in itself provides a firm bond with bitumen.

Furthermore, the underside of the composite of the textile lattice and the thin fleece may be provided with a bituminous mastic. This bituminous mastic melts when the hot asphalt mixture needed to form the bituminous surfacing is deposited on the laid lattice matting. It is advantageous to apply the bituminous mastic only in spots or stripes parallel with the winding axis in order to preserve the flexibility of the reinforcing lattice. The quantity of the bitumenlatex emulsion to be sprayed on the road level is considerably reduced by the bituminous mastic on the composite and may even be omitted completely. The installation of the lattice is simplified and the time for installing the reinforcement is reduced. The quantity of the mastic to be applied depends on the condition of the asphalt or road surfacing to be renewed. It ranges preferably from 150 g to 500 g/m$^2$.

The description given below, in conjunction with the appended drawings, provides an explanation of an embodiment of the invention. Of the drawings,

DESCRIPTION OF PREFERRED EMBODIMENTS

Figure 1:
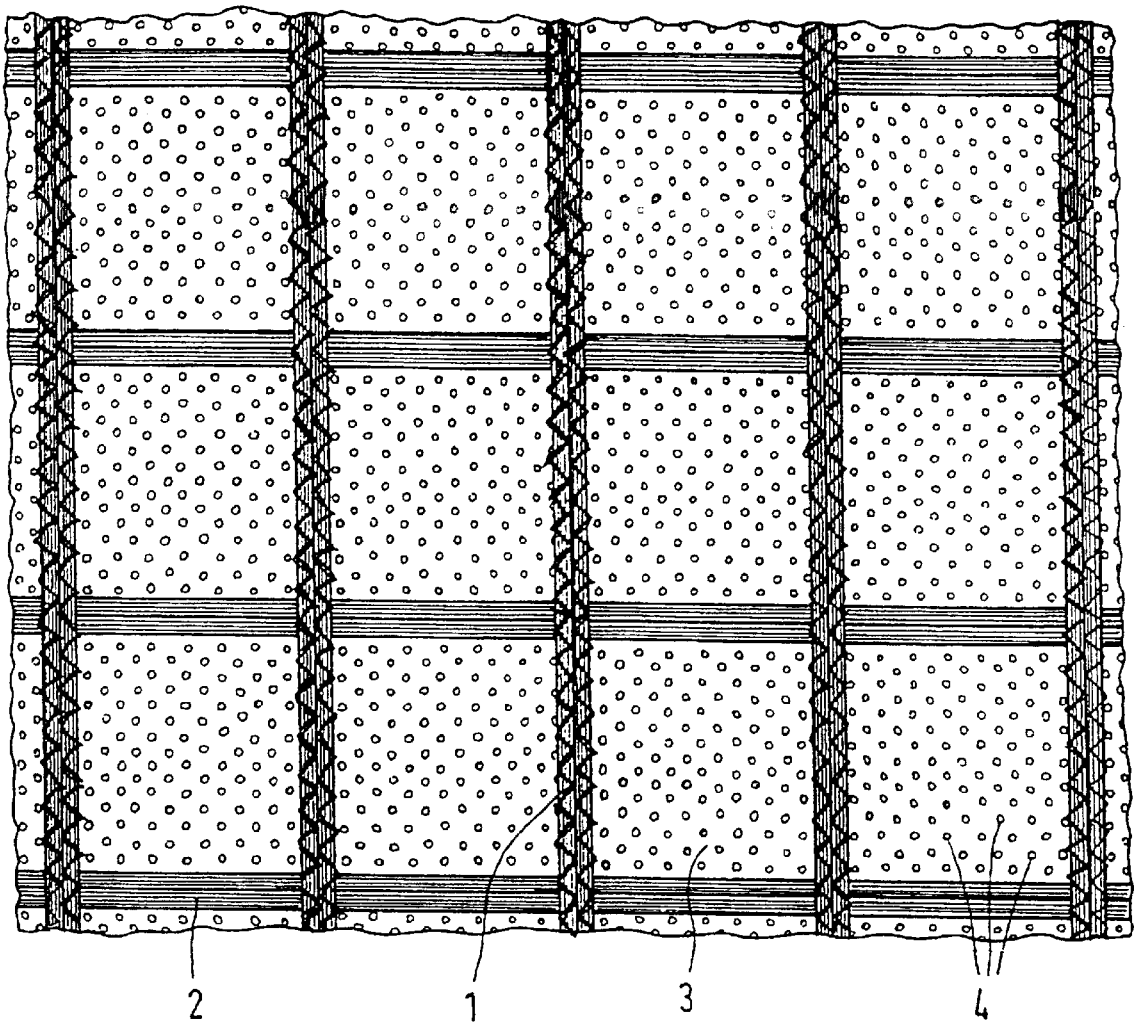
FIG. 1 is a plan view of a reinforcing lattice of the invention.
Figure 2:
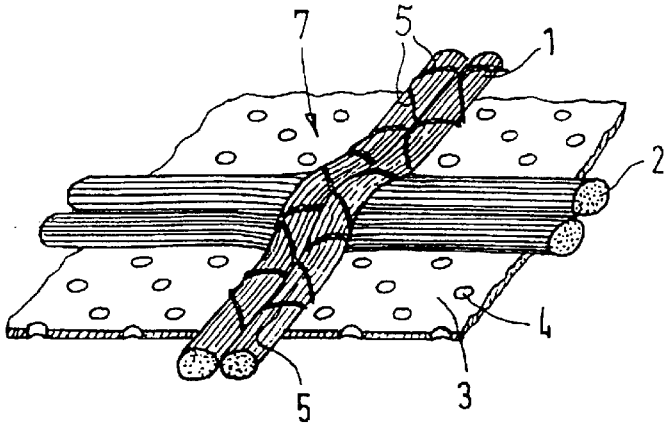
FIG. 2 is a detail of a cross-over point of the reinforcing lattice.
Figure 3:
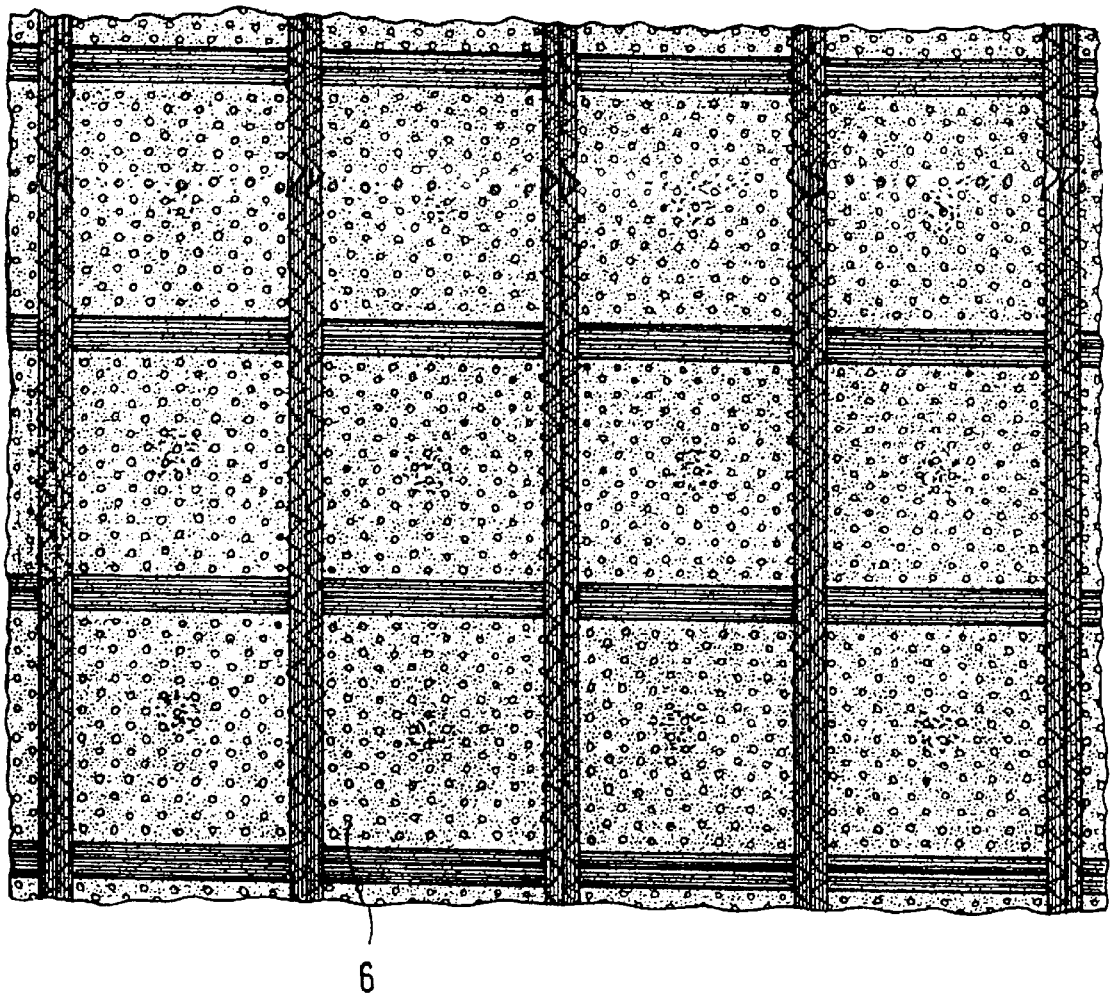
FIG. 3 shows a reinforcing lattice such as that of FIG. 1 coated with a bonding compound.

The textile lattice for providing reinforcement for bitumen-bonded layers illustrated in FIGS. 1 to 3 essentially consists of two sets of parallel load-bearing threads 1 and 2. The threads 1 of the lattice run in the direction of the warp or longitudinal direction of the lattice whilst the threads 2 run transversely thereto. The load-bearing threads are made from highly modular polymer fibers or polycondensate fibers, for example fibers made of aramide or polyvinyl alcohol, in particular in the form of endless fibers. However, the load-bearing fibers may also be glass fibers. The threads 1 extending longitudinally, each made up of two bundles of fibers in the embodiment illustrated, are surrounded by Raschel locking threads 5, which join the longitudinally extending threads 1 as well as the transversely extending threads 2 to a thin fleece 3. As can be seen with particular clarity from FIG. 2, the threads 2 extending transversely are arranged between the fleece 3 and the threads 1 which extend longitudinally. This layout is more stable than an arrangement whereby the threads 2 extending transversely run across the longitudinally extending threads 1. The load-bearing threads 1 and 2 may be impregnated or coated with a bonding compound even before they are secured to the fleece 3 by Raschel-locking. For practical purposes, however, the load-bearing threads 1 and 2 are coated with the bonding compound 6 on the fleece 3. In order to keep the consumption of bonding compound, in particular a bitumen-latex emulsion, within limits, the layer applied is so thin that the fleece 3 is still permeable to air.

As can be seen particularly clearly from FIGS. 1 and 2, the fleece 3 is perforated. Holes 4 of a 0.5 to 4 mm diameter are punched through the fleece in a regularly distributed pattern. The proportion of holes in relation to the total surface area of the fleece is at least 10%.

The fleece 3, which is made from PETP, PET or PP fibers, threads or filaments and hardened by heat, chemical or mechanical processing, weighs from 10 to 50 g/m$^2$.

The Raschel threads 5 used to secure the lattice are perfectly adequate as a rule. In specific circumstances, however, the load-bearing threads may also be additionally bonded to one another by bonding or welding at their cross-over points.

In order to produce a firm bond for the layers of an asphalt surfacing, it is an advantage if the load-bearing threads 1 and 2 are not flat but rounded and of a diameter of from 2 to 4 mm.

A bituminous mastic melting at 60° C. is applied to the lower surface of the reinforcing lattice in form of spots (not shown) or stripes parallel to the rolling axis in order to preserve the flexibility of the composite comprising the lattice 1, 2, the fleece 3, the coating 6 having an affinity for bitumen and meltable bituminous mastic is preserved.

What is claimed is:

1. A wide-meshed, textile lattice to provide reinforcement for bitumen-bonded layer comprising: a first and a second set of parallel, load-bearing threads, wherein the first set of threads extends in a longitudinal direction of the lattice and the second set of threads extends transversely to the longitudinal direction of the lattice and wherein the threads are made of glass fibers or synthetic fibers and are Raschel-locked on a fleece by Raschel-locking threads, wherein the Raschel-locked threads surrounds the longitudinally extending threads of the lattice and secure the transversely extending threads, wherein the fleece has a weight of 10 to 50 g/m$^2$ and the load-bearing threads are treated and coated together with the fleece with a bonding substance that enhances bonding to bitumen, and wherein the fleece is perforated in order to be permeable to air.

2. The lattice as claimed in claim 1, wherein holes of a diameter from 0.5 to 4 mm are punched in the fleece in a regularly distributed pattern and the ratio of a surface area of the holes to total surface area of the fleece is at least 10%.

3. The lattice as claimed in claim 1 wherein a bituminous mastic which can be activated by heating is applied to an underside of at least one of the fleece and the load-bearing threads.

4. The lattice as claimed in claim 3, wherein the bituminous mastic is applied in form of spots or stripes extending transversely or orthogonal to the longitudinal direction of the lattice.

5. The lattice as claimed in claims 1, 2, 3, or 4, wherein the transversely extending threads are arranged between the fleece and the longitudinally extending threads.

6. The lattice as claimed in claim 1, wherein the load-bearing threads are joined to one another at cross-over points by bonding or welding.

7. The lattice as claimed in claim 1, wherein the load-bearing threads are in the form of rounded 2 to 4 mm diameter strands or double strands which are secured to the fleece by Raschel-locking.

8. A wide-meshed lattice for providing reinforcement for bitumen-bonded layers comprising: two sets of parallel, load-bearing threads, wherein one set of threads extends in a longitudinal direction of the lattice and an other set of threads extends perpendicularly to the longitudinal direction of the lattice and the threads are made of synthetic fibers and are Raschel-locked onto a fleece by Raschel-locking threads, with the Raschel-locking threads surrounding the longitudinally extending threads and securing the transversely extending threads, wherein the synthetic fibers enhance bonding to bitumen or a bonding substance and the fleece has a weight of less than 50 g/m$^2$.

9. A composite lattice assembly for reinforcing bituminous layers comprising:

a fleece member;

a first set of lattice threads arranged on the fleece member;

a second set of lattice threads are least partially crossing over the first set; and a plurality of Raschal threads securing the lattice threads of at least one of the first asn second sets to the fleece member; and a plurality of openings formed on the fleece member, wherein the fleece member is coated with a bonding substance that enhances bonding to bitumen and permits air to pass through the plurality of openings.

10. The lattice according to claim 9, wherein the fleece member and the threads are provided with an adhesive coating that enhances bonding to bitumen.

11. The lattice according to claim 10, wherein the openings extend through the adhesive coating.

12. The lattice according to claim 9, wherein the fleece member has a weight of between 10 and 50 $g/m^3$.

13. The lattice according to claim 10, wherein the adhesive coating is activated by heat.

14. The lattice according to claim 9, wherein at least one of the sets of lattice threads is made of a material that enhances bonding to bitumen.

15. The lattice according to claim 14, wherein the material bitumen is selected from the group consisting of polymerisate fibers and polycondesante fibers.

16. The lattice according to claim 9, wherein the fleece member having the openings is permeable to air.

17. A wide-meshed, textile lattice to provide reinforcement for bitumen-bonded layers, in particular of a road surfacing, which comprises two sets of parallel, load-bearing threads, wherein one set of threads extends in a longitudinal direction of the lattice and the other set of threads extends transversely to the longitudinal direction of the lattice and the threads are of glass fibers or, and wherein the lattice is coated with a bonding substance to bitumen or the crossing threads are made from material with an affinity for bitumen, and wherein the crossing threads are raschel-locked onto a fleece, that has a weight of 10 to 100 $g/m^2$, wherein the fleece is treated and coated with the bonding substance that enhances bonding bitumen, wherein the fleece has openings in the bonding substance in order to be permeable to air.

18. A wide-meshed, textile lattice to provide reinforcement for bitumen-bonded layers, which comprises two sets of parallel, load-bearing threads, wherein one set of threads extends in the longitudinal direction of the lattice and the other set of threads extends transversely to the longitudinal direction of the lattice and the threads are of glass fibres or synthetic fibres, and wherein the lattice is coated with a bonding substance having an affinity to bitumen or the crossing threads are made from material that enhances bonding to bitumen, and wherein the crossing threads are raschel-locked onto a fleece, and wherein a thin fleece with a weight of 10 to 50 $g/m^2$ is used, which provides firm keying action between coarse grains of a surfacing mixture laid on top of the lattice and coarse grains of a surfacing mixture underneath the lattice.

* * * * *